United States Patent [19]

Richmond et al.

[11] 3,938,597

[45] Feb. 17, 1976

[54] PORTABLE EARTH BORING MACHINE

[75] Inventors: Albert R. Richmond, West Salem; William S. Appleman, Ashland, both of Ohio

[73] Assignee: The Richmond Manufacturing Company, Ashland, Ohio

[22] Filed: Nov. 29, 1974

[21] Appl. No.: 528,464

Related U.S. Application Data

[63] Continuation-in-part of Ser. No. 471,440, May 20, 1974.

[52] U.S. Cl. ..... 175/24; 175/61; 175/73; 299/1; 173/2

[51] Int. Cl.[2] ..... E21B 7/10

[58] Field of Search ..... 175/24, 45, 62, 61, 62, 175/73, 74; 299/1; 173/2

[56] References Cited

UNITED STATES PATENTS

| | | | |
|---|---|---|---|
| 3,326,008 | 6/1967 | Baran et al. | 175/73 X |
| 3,526,285 | 9/1970 | Adkins et al. | 175/73 |
| 3,767,836 | 10/1973 | Geis et al. | 175/24 |
| 3,851,716 | 12/1974 | Barnes | 175/45 |
| 3,857,449 | 12/1974 | Kimura | 175/45 |

FOREIGN PATENTS OR APPLICATIONS

| | | | |
|---|---|---|---|
| 259,009 | 6/1970 | U.S.S.R. | 299/1 |

*Primary Examiner*—Ernest R. Purser
*Assistant Examiner*—Richard E. Favreau
*Attorney, Agent, or Firm*—Palmer Fultz, Esq.

[57] ABSTRACT

A portable earth boring machine for the horizontal boring of shafts and the insertion of pipeline casing sections in installations where excavation from the surface is undesirable. The machine is characterized by a steering head positioned at the front of the casings which steering head is automatically controlled so as to directionally control the direction of extension of the pipeline as the drilling operation progresses.

8 Claims, 9 Drawing Figures

PORTABLE EARTH BORING MACHINE

REFERENCE TO CO-PENDING APPLICATION

This application is a continuation-in-part of our co-pending application Ser. No. 471,440 filed May 20, 1974.

BACKGROUND OF THE INVENTION

This invention relates to portable earth boring machines and more particularly to a machine adapted for horizontal boring of shafts for the insertion of pipelines at installations where excavation from the surface is undesirable.

SUMMARY OF THE INVENTION

In general, the machine of the present invention comprises a base means that includes spaced track members which are disposed in a trench adjacent to the hill to be bored. The machine further includes a frame means mounted for movement along the track means and such carriage supports a power train for rotating connected sections of auger shafts which comprise a progressively extendable boring auger. The frame means further supports a pusher ring for driving sections of casings into the bored hole and an associated pushing cylindrer means is provided for advancing and retracting the frame means and pusher ring along the track means.

In accordance with the present invention the earth boring machine is provided with a novel adjustable steering head provided with automatic control apparatus for varying the angle of inclination of such steering head so as to directionally control the path of the pipeline as the boring operation progresses.

As another aspect of the present invention the adjustable steering head is easily fabricated by modifying a standard casing section so as to include a simple flush type pivot hinge.

As still another aspect of the present invention the boring machine is provided with a remote grade indicator which includes a casing position sensing means mounted on the above mentioned steering head as well as a read-out gauge positioned at the operator's location with such remote grade indicator serving to continuously read-out the position of the earth boring head above or below the desired pipeline path.

It is therefore an object of the present invention to provide novel steering head means for automatically controlling the establishment of grade in the boring of a pipeline hole.

It is another object of the present invention to provide in an apparatus of the type described a remote grade indicator which provides indicia to the operator with respect to the grade position of the boring head during the drilling operation.

Further objects and advantages of the present invention will be apparent from the following description, reference being had to the accompanying drawings wherein preferred forms of embodiments of the invention are clearly shown.

DESCRIPTION OF PREFERRED EMBODIMENTS

Figure 2:
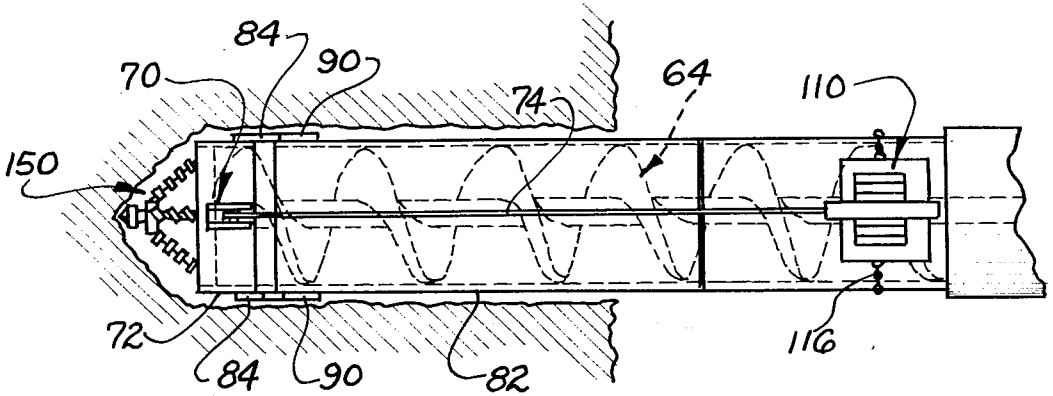
FIG. 2 is a partial top elevational view of the apparatus of FIG. 1.
Figure 1:
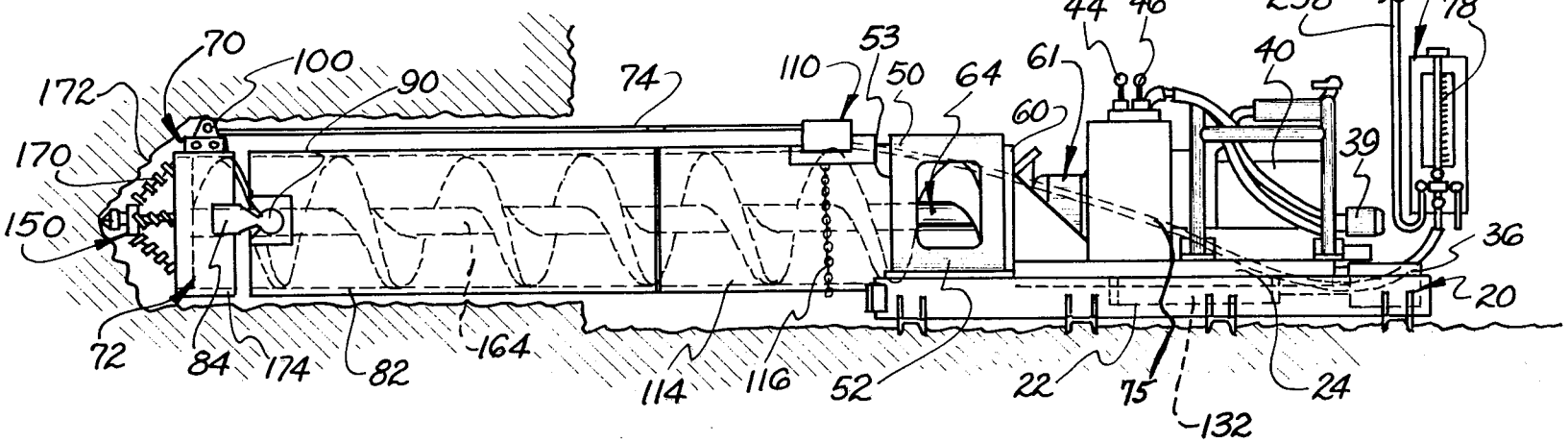
FIG. 1 is a side elevational view of a boring machine constructed in accordance with the present invention.

Referring in detail to the drawings, FIG. 1 illustrates the complete horizontal earth boring machine of the present invention which comprises a base means indicated generally at 20. Such base means includes spaced longitudinally extending track means 22 which support a carriage means indicated generally at 24.

The carriage means 24 is advanced and retracted along track 22 by a hydraulic pushing cylinder seen at 132 in FIG. 1, with such pushing cylinder being operatively connected between a power cylinder base 36 and the carriage means 24.

Details of typical pushing cylinders such as 132 and power cylinder base 36 are disclosed and described in detail in the application of Albert R. Richmond, Ser. No. 867,816, filed Oct. 20, 1969, now U.S. Pat. No. 3,612,195 issued Nov. 12, 1971.

It will be further seen that pressurized fluid for actuating pushing cylinder 132 is provided by a fluid power system including a pump 39 driven by an engine 40. The fluid power circuit further includes control valve mechanisms 44 and 46 which are actuated when the pushing cylinders are extended or retracted so as to move carriage 24 forwardly or rearwardly along the track means 22.

Referring again to FIG. 1, the boring machine further includes a pusher ring 50 including a front annular surface 53 for engaging the sections of pipe casing for pushing such sections into the bored hole. Such pusher ring 50 includes a thrust plate means 60 mounted on the carriage means for absorbing the pushing thrust and the boring thrust of the auger assembly indicated generally at 64. A hydraulic drive assembly 61 is interposed between engine 40 and auger assembly 64, such hydraulic drive arrangement being described in co-pending application Ser. No. 337,211 filed Mar., 1973, now U.S. Pat. No. 3,870,110.

A typical auger construction for connection with the machine of the present invention is disclosed and described in detail in the application of Albert R. Richmond, Ser. No. 85,614 filed Oct. 30, 1970, now U.S. Pat. No. 3,693,734 issued Sept. 26, 1972.

Reference is next made to the remote grade indicating apparatus of the present invention which is shown in assembled relationship with the boring machine in FIG. 1 and which comprises a sensing means indicated generally at 70 which is mounted on the foremost casing portion 72. The apparatus further includes includes a gauge means indicated generally at 45, which gauge means is located at the operator's station of the boring machine, as seen in FIG. 1, and serves to continuously provide read-out information with respect to deviation in the inclination or declination of the bored hole as the drilling operation progresses.

Details of the remote grade indicating apparatus are described and disclosed in detail in the co-pending application of Thomas W. Barnes, Ser. No. 354,998 filed Apr. 27, 1973 now Pat. No. 3,851,716.

In the present application of the remote grade indicating apparatus the fluid conduit connection between the sensing means 70 and gauge 45 is provided by a hollow passage through rod 74 and flexible lines 75 and 77. Such rod 74 serves the additional function of a push rod for actuating the steering head 72 of the present invention in a manner later to be described.

In general, the remote grade indicating apparatus 45–70 functions in accordance with the principle that liquid in a conduit system will seek a common level and since water is present in the sensing means and also in the visual gauge tube 78 of gauge 45 the level of the liquid in the gauge tube will always be the same as the level of the liquid in the sensing means 70. Hence it will be understood that by reading the level in the liquid tube 78, provided with grade indicia above and below a zero datum, the operator can at any time determine the height of the boring auger and steering head with respect to a predetermined datum line.

Reference is next made to the steering head apparatus. One of the modifications which is hydraulically actuated is illustrated in FIGS. 1–3 and 4–7 and includes a pivoted head indicated generally at 72 formed from a length of standard casing section 80 which is pivotally connected to a second casing section 82 at a pivot joint comprising right and left male pivot members 84. Each pivot member includes a male protrusion 86 positioned in recesses 88 formed in female pivot portions 90. It should be pointed out that the male and female pivot portions 84 and 90 are each respectively mounted in cut-outs 92 and 94 which cut-outs can easily be made at the boring site by means of a cutting torch with the pivot portions 84 and 90 being welded in the cut-outs at the welded junctions 96.

With this arrangement the pivot portions 84 and 90 are relatively flush with the outer surface of the casing sections with back-up plates 103 being lapped against the inner surfaces of the second casing section 82 so as to retain the male members 86 in position.

Steering head 72 is actuated by a push rod 74 having its forward end pivotally connected to a bracket 100 at a pivot 102. Push rod 74 is made up of threaded sections so that its length can be continuously increased as the boring of the hole progresses and additional casing sections are inserted into the hole.

Rod 74 is extended and retracted, in one embodiment, by an actuating means indicated generally at 110 in FIGS. 3, 5, 6, and 7. Such assembly includes a saddle 112 which is removably attached to the base casing section 114 by a chain 116 which can be provided with a quick disconnect clamp not illustrated.

Saddle 112 mounts two single acting power cylinders 120 and 122 which are secured to saddle 112 at the welds 124. The power cylinders 120 and 122 include extendable and retractable rods 126 which actuate a slide 128 provided with laterally extending shoulders 130 engaged by the ends of cylinder rods 126. Power cylinders 120 and 122 are of the single acting type and receive pressurized fluid from a conventional pump and valve circuit not illustrated.

Slide 128 is mounted in guides 134 and the ends of actuating rod 74 are connected to the slide at the threaded junction 136.

Figures 3, 4:
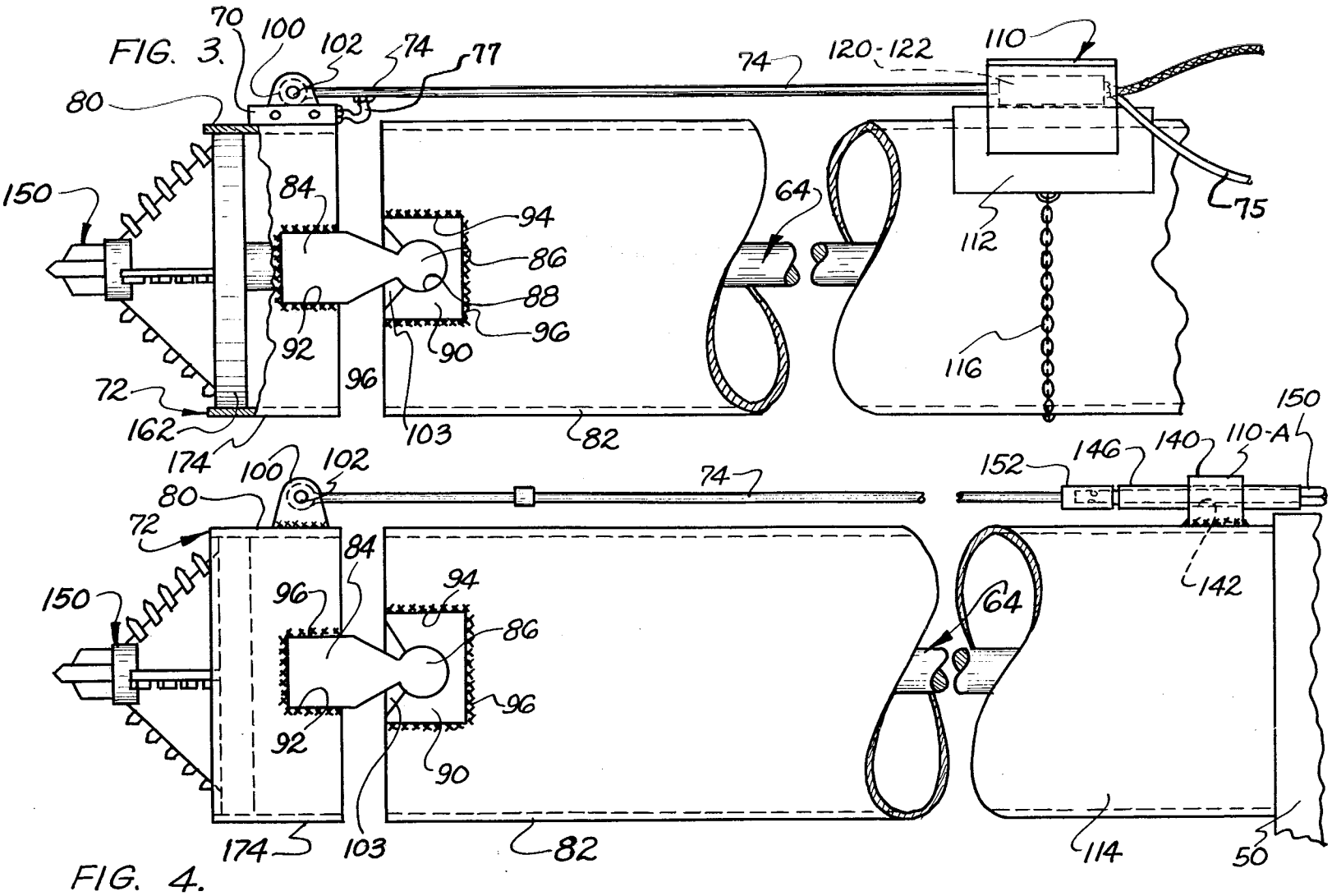
FIG. 3 is a partial side elevational view, partially in section, of the apparatus of FIGS. 1 and 2.
FIG. 4 is a partial side elevational view showing a modified steering head and control apparatus for the machine of FIG. 1.
Figure 6:
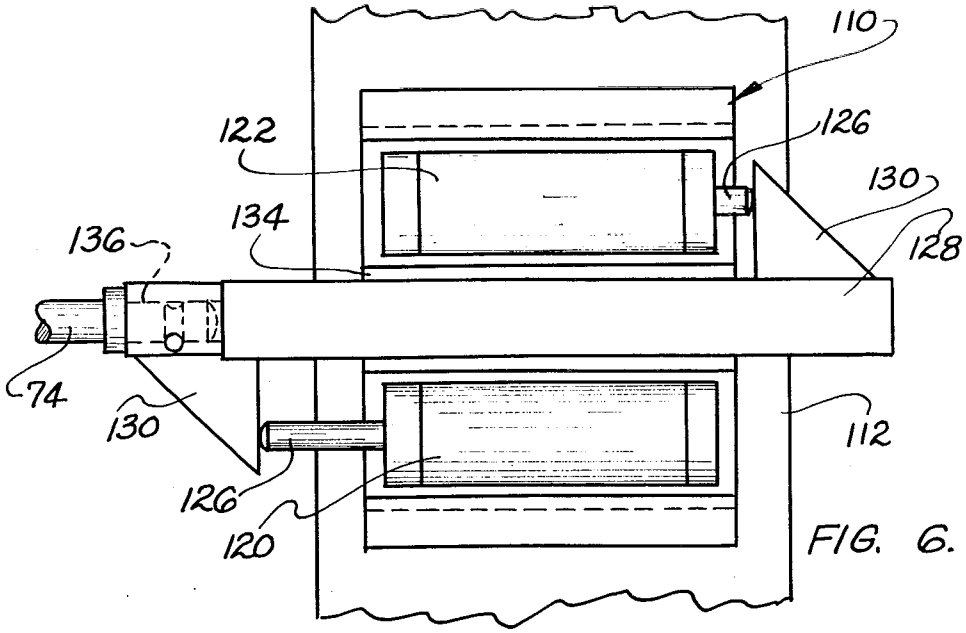
FIG. 6 is a partial top elevational view corresponding to FIG. 5.

Reference is next made to FIG. 4 which illustrates a modified control apparatus that includes the same pivot members 84–90 as well as the push rod 74 and bracket 100 previously described.

The modification of FIG. 4 differs, however, in that it includes a screw type actuating means 110-A that consists of a female threaded member 140 provided with a threaded bore 142. A male threaded member 146 is mounted for extension and retraction upon rotation of a head 150 with the forward end of male member 146 being connected to actuating rod 74 at a swivel connector 152.

Referring again to FIGS. 1–3, a boring head indicated generally at 150 is normally partially extended outwardly of the steering head 72 such that the base plate 162 turns just inside the forward end of steering head 72, and whereas the exposed cutters engage the earth.

A plurality of individual auger sections 164 are in driving connection with the rear end of boring head 150 and are in turn joined end to end at disconnectable junctions in the conventional manner such that auger sections can be added as the boring progresses.

In operation, when it is desired to increase the inclination of steering head 72 the operator pressurizes the previously mentioned hydraulic system so as to extend ram 126 of power cylinder 122. When this occurs the other ram 126 of power cylinder 120 will retract shifting slide 128 rearwardly thereby causing tension on push rod 74 which tilts steering head 72 upwardly about the pivotal center of the pivot portions 86-90. The auger head 150 is driven by engine 40 causing the upper portion 170 of auger head 150 to bite upwardly into the earth fill 172. The drilling action will cause the drillings to drop downwardly and cause wedging action on the under surface 174 of steering head 72. Hence, when the casing sections are advanced by the pressurization of pushing cylinders 36, the upwardly tilted steering head 72 is moved forwardly and over the previously mentioned earth drillings which drillings exert an upward force casuing the boring head 150 to drill in an upward direction.

When it is desired to decrease the grade angle, then the previously mentioned power cylinders 120–122 are actuated in the opposite direction causing the steering head 72 to decline whereby the boring auger 150 will work downwardly.

Figure 8:
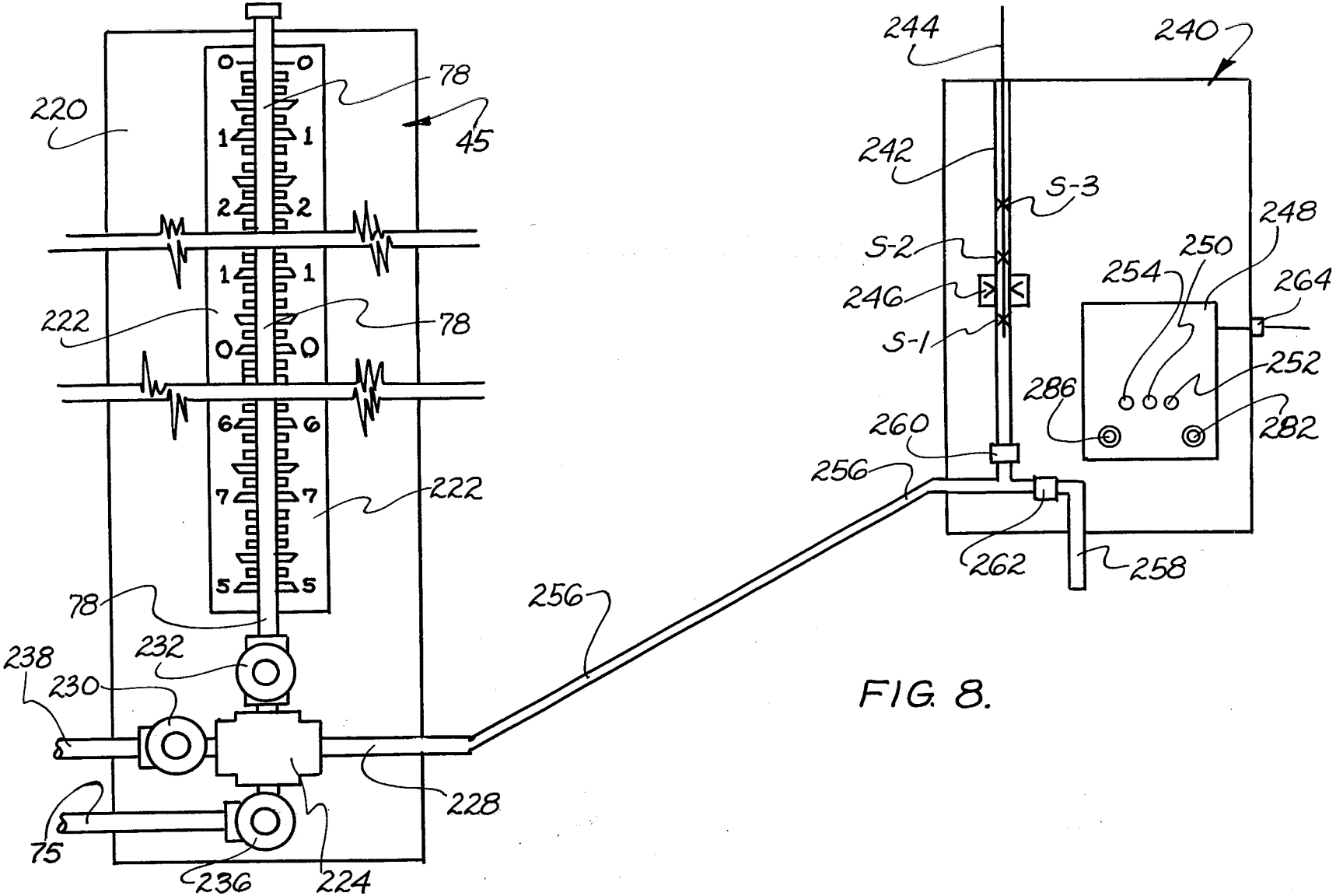
FIG. 8 is a front elevational viw showing the remote grade indicating gauge and automatic control panel for the boring maching of the preceding figures.
Figure 9:
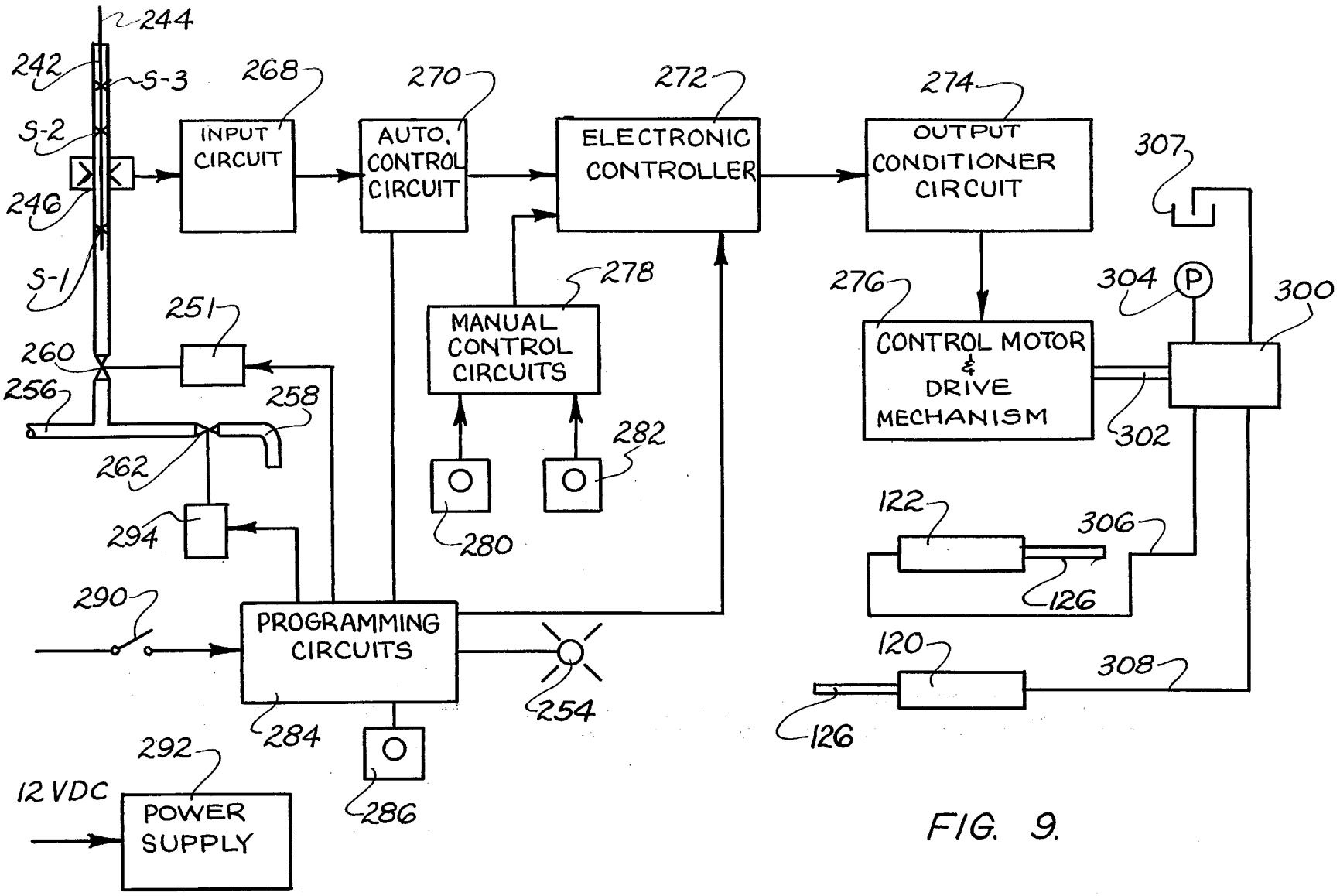
FIG. 9 is a diagrammatic view of a circuit for the automatic control system of the present invention.

Referring next to FIG. 8, the apparatus further comprises an automatic control panel indicated generally at 240 which includes electronic control circuits which are diagrammatically illustrated in the circuit of FIG. 9. This automatic system can be used to operate the previously described hydraulic cylinders 120–122 for the purpose of automatically maintaining the predetermined grade of drilling operation. In this instance, the automatic control is applied to a "down power cylinder 120" and an "up power cylinder 122" as previously described.

Referring particularly to the control panel 240, the apparatus includes a control tube 242 which communicates with the previously described water gauge tube 78 of the gauge means 45 via a connecting tube 256 such that the water level in the control water tube 242 will at all times be equal to the water level in gauge tube 78, as well as equal to the water level at the sensing means 70.

Referring agin to FIG. 8, the existing water level is sensed by a level control sensor rod 244 mounted in control tube 242 with such rod 244 including three axially spaced metal sensors diagrammatically represented at S-1, S-2, S-3. The lower sensor S-1 functions to sense a low water level which indicates that steering head 72 is working downwardly, whereas the middle sensor S-2 senses the high level of the water which in turn indicates that steering head 72 is working upwardly. The top sensor S-3 functions to sense when the water in control tube 242 is at a high enough level for the supply to be turned off so that the system can settle out for a reading.

Figure 7:
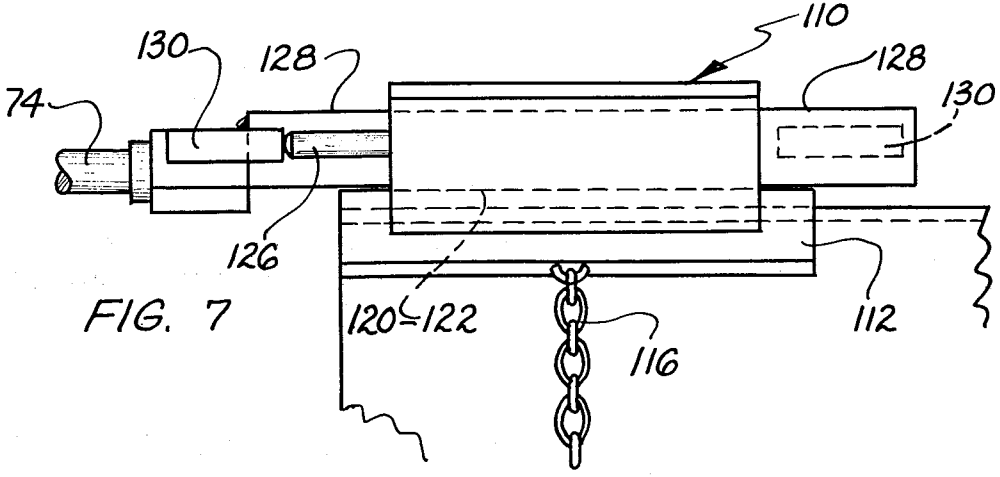
FIG. 7 is an enlarged partial side view of the modification of FIG. 4.
Figure 5:
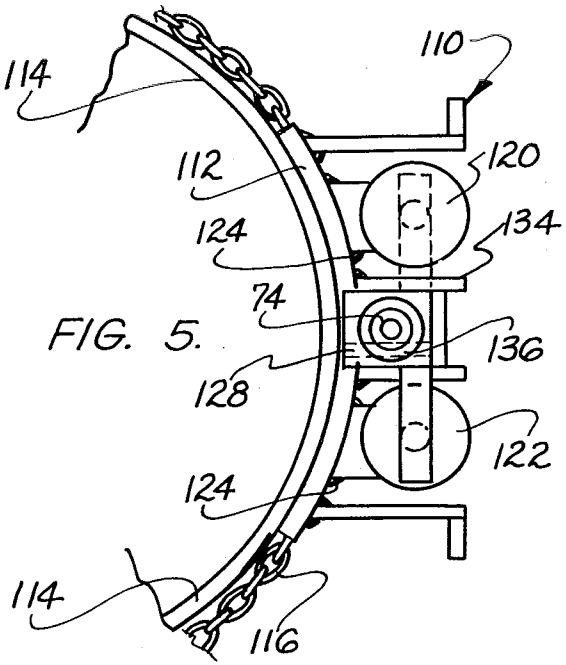
FIG. 5 is a partial front elevational view of the modification of FIG. 4.

Sensors S-1, S-2, and S-3, diagrammatically iilustrated in FIGS. 7 and 8, are small wires or metal elements the electrical resistance of which changes upon emersion in water when the level in control tube 242 changes to cause such emersion. Such changes in electrical resistance function as input signals to comparers in input conditioning circuits 268.

The above mentioned sensors are connected to input conditioning circuit 268 by a loom of wires indicated diagrammatically at 246, FIG. 9, and when the water level reaches the metal sensors S-1, S-2, and S-3, the comparers in the input conditioning circuits 268 change state.

The system of FIG. 9 further includes an automatic control circuit 270 and an electronic controller 272 which effect a memory function and also control an output signal to a control motor and drive mechanism 276 with such output signal being selectively actuated by programming circuits 284.

Programming circuits 284 at the outset of operation serve to connect the system with a water supply via line 238 upon actuation of a solenoid 251 of a water inlet valve 260. This allows water to flow up into the water level control tube 242. Subsequently, after a time delay to permit the system to stabilize the sensing circuits function to determine the water level in water level control tube 242 with the information being electronically stored in the memory circuits. At this time one of the signal lights 254 comes on to indicate to the operator that the boring machine should be started. After the machine is operating a signal is sent from the memory circuits to the programming circuits which institute operation of the control motor 276 to effect the necessary movement of the steering head as indicated by the memory signals.

Referring again to FIG. 9, the circuit further includes an output conditioner 274 which consists of a group of power output circuits which drive control motor 276.

As seen in FIG. 9, the operation of the control system is activated by control button 286.

Another feature of the control circuit comprises a machine turning limit switch 290 which is connected to the programming circuits 284 for the purpose of limiting the movement of the steering head beyond a predetermined maximum angle.

Still another feature of the automatic control circuit of FIG. 9 consists of an optional manual control circuit 278 which is shown provided with an "up" manual control button 280 and a "down" manual control buttom 282 with respective lights 250 and 252.

As seen in FIG. 9, previously described cylinders 120–122, FIGS. 1–7, are selectively pressurized responsive to the appropriate control signal when control motor 276, FIG. 9, operates to shift an actuator 302 of a control valve 300.

When control motor 276 extends to shift actuator 302 to the right, then the "down" motor 120 is pressurized with the "up" motor 122 being connected to tank 307. Pressurization of "down" motor 120 is effected by pressurized fluid from a pump 304 which may be driven by the boring machine. This causes steering head 72 to be pivoted downwardly which in turn causes the boring operation to decrease the grade being established.

Similarly, when control motor 276 shifts valve actuator 302 to the left, then the other head actuating motor or "up" motor 122 is connected to pump 304 via valve 300 and at the same time "down" motor 120 is connected to tank 307. This causes the boring head 72 to pivot upwardly thereby increasing the angle of grade being established.

After a correction has been made, when the sensors detect that the steering head 72 is back on grade then the circuits function to center valve 300 and the head angle is maintained until the sensors detect that another correction of head angle is required.

When it is desired to bleed the circuit, valve 262 is actuated via a solenoid 294 with such bleeding function being automatically controlled by the programming circuits 284.

Referring in detail to FIGS. 1 and 8, the remote sensing apparatus further includes a gauge means indicated generally at 45 that includes a transparent tube 78 mounted on a frame 220 in overlying relationship with an indicia scale 222 which includes the zero base and the related indicia marks which divides the scale into units, for example one-hundredths of a foot.

Gauge means 45 communicates with a water supply via a tube 238 which enters a valve 230 leading to fitting 224.

The apparatus further includes a valve 236 communicating with tube 75 that in turn is connected to the previously described sensing means 70.

The system is charged from supply tank via gravity through open valves 230, 236, 232, and 260. Valve 230 is closed when lines 238 and 256 are full and free of air. Vavle 236 is next closed and the valve 232 is closed when transparent tube 78 is full and valve 260 is closed when transparent tube 242 is full.

Valves 236, 232 and 260 are next opened and the water will seek its level in transparent tube 78 and 242 as dictated by the vertical location of sensing means 70.

In the event the boring is being conducted at a declined angle the water level will be established at the top of a right reference pin since water can bleed out of a sensor outlet until such level is established.

When the boring operation is being conducted at an inclined angle then the water level in gauge tube 78 and 242 will correspond with the top of the other reference pin.

At the outset of the boring operation, before steering head 72, and the gauge 70 mounted thereon, are buried in the earth fill, the apparatus is zeroed merely by placing a conventional surveyor stake, not illustrated, on top of one of the reference. The zero indicia mark on gauge 45 is then established at the same horizontal level as one of the reference pins by sighting along an indicia mark on indicia scale 222 and a corresponding mark on the surveyors stake. The surveyors stake is then removed from zeroing the apparatus and the drilling and pushing operations are next commenced.

It should be mentioned that the outlet of the sensing means 70 is superimposed over a drain hole through the wall of steering head 72 to provide means for releasing water from the outlet.

It will now be understood that after sensing means 70 disappears into the earth fill, as seen in FIG. 1, the zero grade position of the steering head 72 will be present when the water level is at the zero mark on the indicia scale of gauge 45. Moreover, as the steering head 72 inclines or declines the exact amount of such angular change will be reflected by the water level in the transparent tube 78 and 242 of the gauge.

It should further be mentioned that in instances where the boring apparatus and associated grade indicating apparatus are to be temporarily removed from the earth fill and it is desired to come back to the job and re-operate the apparatus at the same reference, then in such instances a reference means bench mark can be driven into the earth fill adjacent to the gauge and the location of the zero reference on the gauge can be noted on the bench mark using a surveyors transit as a sighting means with such bench mark being left in the boring bed when the apparatus is temporarily removed therefrom. When the apparatus is returned, the operator merely needs to line up the zero on the gauge 45 with the mark location on the bench mark using the transit and the boring operation can be resumed with the same zero reference with respect to grade deviations.

While the forms of embodiments of the present invention as herein disclosed constitute preferred forms, it is to be understood that other forms might be adopted.

What is claimed is:

1. In an earth boring apparatus of the type that forms horizontal holes and pushes sections of casing into said holes, the combination of casing means including a lead casing section including a first longitudinal axis; a second casing section rearwardly adjacent to said lead casing section and including a longitudinal axis normally aligned with said first longitudinal axis; pivot means connecting said lead casing section to said second casing section; actuating means connected to said lead casing section for varying the angle of said first longitudinal axis of said lead casing section relative to said second longitudinal axis of said second casing section; sensing means for progressive extension into the earth fill; gauge means for location adjacent the earth fill and connected to the sensing means, said gauge means including read-out indicia for informing the operator of grade deviations of the sensing means; and automatic control means for energizing said actuating means responsive to sensing of a deviation in grade by said sensing means.

2. The apparatus defined in claim 1 wherein said actuating means comprises a fluid motor.

3. In an earth boring apparatus of the type that forms horizontal holes and pushes sections of casing into said holes, the combination of casing means including a lead casing section including a first longitudinal axis; a second casing section rearwardly adjacent to said lead casing section and including a longitudinal axis normally aligned with said first longitudinal axis; pivot means connecting said lead casing section to said second casing section; actuating means connected to said lead casing section for varying the angle of said first longitudinal axis of said lead casing section relative to said second longitudinal axis of said second casing section; sensing means for progressive extension into the earth fill and including a fluid passage for establishing a fluid level corresponding with grade deviations of the progression into the earth fill; gauge means for observation by the boring machine operator and including a gauge tube communicating with said fluid passage and containing a fluid, said gauge tube being provided with indicia, the level of the fluid in said gauge tube corresponding with said fluid level in said sensing means; and automatic control means for energizing said actuating means responsive to deviations in said fluid level.

4. The apparatus defined in claim 3 wherein said automatic control means includes a level control rod emersed in said fluid; and water level sensors on said control rod for sensing changes in water level caused by grade deviation of the lead casing section with respect to a preselected zero reference line.

5. The apparatus defined in claim 3 wherein said automatic control means includes sensing means emersed in said fluid, said sensing means comprising a lower sensor that senses downward movement of the fluid level in said gauge tube; a middle sensor that senses upward movement of said fluid level; and an upper sensor that senses a fluid level high enough for the grade indicating system to settle out for a reading.

6. In an earth boring apparatus of the type that forms horizontal holes and pushes sections of casing into said holes, the combination of casing means including a lead casing section including a first longitudinal axis; a second casing section rearwardly adjacent to said lead casing section and including a lontiduinal axis normally aligned with said first longitudinal axis; pivot means connecting said lead casing section to said second casing section; actuating means including an actuator base mounted on said apparatus; a pivot bracket mounted on said lead casing section; a fluid motor mounted on said actuator base; means forming a source of pressurized fluid in circuit with said fluid motor; an actuating rod operatively connecting said power means with said pivot bracket; motor control valve means for the flow of pressurized fluid in said fluid circuit; sensing means for progressive extension into the earth fill; guage means for observation by the boring machine operator and including a gauge tube communicating with said fluid passage and containing a fluid, said gauge tube being provided with indicia, the level of the fluid in said gauge tube corresponding with said fluid level in said sensing means; and automatic control means for operating said motor control valve means responsive to deviations in said fluid level.

7. The apparatus defined in claim 6 wherein said automatic control means includes a level control rod emersed in said fluid; and water level sensors on said control rod for sensing changes in water level caused by grade deviation of the lead casing section with respect to a preselected zero reference line.

8. The apparatus defined in claim 7 wherein said automatic control means includes sensing means emersed in said fluid, said sensing means comprising a lower sensor that senses downward movement of the fluid level in said gauge tube; a middle sensor that senses upward movement of said fluid level; and an upper sensor that senses a fluid level high enough for the grade indicating system to settle out for a reading.

* * * * *